US006080215A

United States Patent [19]

Stubbs et al.

[11] Patent Number: 6,080,215

[45] Date of Patent: Jun. 27, 2000

[54] ABRASIVE ARTICLE AND METHOD OF MAKING SUCH ARTICLE

[75] Inventors: Roy Stubbs, Nuneaton, United Kingdom; Scott R. Culler, Burnsville, Minn.; Mara E. Liepa, St. Paul, Minn.; Donna W. Bange, Eagan, Minn.; John D. Haas, Roseville, Minn.

[73] Assignee: 3M Innovative Properties Company, St. Paul, Minn.

[21] Appl. No.: 09/011,361

[22] PCT Filed: Aug. 12, 1996

[86] PCT No.: PCT/US96/13100

§ 371 Date: Feb. 4, 1998

§ 102(e) Date: Feb. 4, 1998

[87] PCT Pub. No.: WO97/06928

PCT Pub. Date: Feb. 27, 1997

[51] Int. Cl.[7] ..... B24D 3/00; B24D 17/00

[52] U.S. Cl. ..... 51/295; 51/293; 51/298; 51/309

[58] Field of Search ..... 51/295, 307, 309, 51/298, 293

[56] References Cited

U.S. PATENT DOCUMENTS

| | | | |
|---|---|---|---|
| 449,930 | 4/1891 | Dubey . | |
| 875,936 | 1/1908 | Landis . | |
| 3,339,319 | 9/1967 | Schuster et al. | 51/395 |
| 3,362,845 | 1/1968 | Brundige | 117/76 |
| 3,459,153 | 8/1969 | Alix | 118/102 |
| 3,621,615 | 11/1971 | Ottinger | 51/5 |
| 4,025,671 | 5/1977 | Creamer | 427/286 |
| 4,344,989 | 8/1982 | Thornton et al. | 427/286 |
| 4,356,216 | 10/1982 | Gailey et al. | 427/286 |
| 4,356,217 | 10/1982 | Wollam et al. | 427/286 |
| 4,381,726 | 5/1983 | Hojberg | 118/315 |
| 4,565,034 | 1/1986 | Sekiya | 51/401 |
| 4,644,703 | 2/1987 | Kaczmarek et al. | 51/401 |
| 4,734,104 | 3/1988 | Broberg | 51/295 |
| 4,737,163 | 4/1988 | Larkey | 51/295 |
| 4,930,266 | 6/1990 | Calhoun et al. | 51/293 |
| 4,951,423 | 8/1990 | Johnson | 51/168 |
| 5,048,453 | 9/1991 | Eriksson | 118/249 |
| 5,107,626 | 4/1992 | Mucci | 51/218 R |
| 5,152,917 | 10/1992 | Pieper et al. | 51/295 |
| 5,307,954 | 5/1994 | Gick et al. | 222/94 |
| 5,366,523 | 11/1994 | Rowenhorst et al. | 51/293 |

FOREIGN PATENT DOCUMENTS

| | | | |
|---|---|---|---|
| 0 554 668 A1 | 8/1993 | European Pat. Off. | B24D 11/00 |
| 2 699 417 | 6/1994 | France | A63C 11/00 |
| 4-141377 | 5/1992 | Japan | B24D 11/04 |
| 4-210383 | 7/1992 | Japan | B24D 11/00 |
| 6-278042 | 10/1994 | Japan | B24D 11/04 |
| 377-218 | 6/1964 | Switzerland . | |
| 1787756 | 1/1993 | U.S.S.R. | B24D 11/02 |
| WO 95/07797 | 3/1995 | WIPO | B24D 11/00 |

*Primary Examiner*—Michael Marcheschi
*Attorney, Agent, or Firm*—Paul W. Busse

[57] ABSTRACT

A method for making an abrasive article having at least two abrasive coatings having different abrasive natures. The abrasive natures can differ, for example, by abrasive particle size, abrasive particle type, abrasive particle shape, filler, surfactant, or coupling agent. In another embodiment, the abrasive article can be a structured abrasive article comprising abrasive composites. In another aspect of the invention, the article can have a coating having a single abrasive nature, where the composites comprising the coating are free of abrasive particles.

13 Claims, 3 Drawing Sheets

ABRASIVE ARTICLE AND METHOD OF MAKING SUCH ARTICLE

BACKGROUND OF THE INVENTION

1. Field of the Invention

The present invention relates to a method of making a coated abrasive article comprising a backing having at least two coatings bonded thereon, wherein the abrasive nature of the coatings differs. In one aspect, the abrasive nature can based on the lack of abrasive particles.

2. Discussion of the Art

Abrading or polishing operations sometimes occur where a finer finish is desired on one portion of a surface of a workpiece than on another portion, such as thin film rigid disks for the computer industry. A conventional method of producing such a final surface is to sequentially contact the workpiece with separate abrasive articles having different abrasive natures relative to each other. For instance, the entire workpiece surface may first be finished with a coarse abrasive article, leaving a rough finish, followed by finishing the portion thereof needing a fine finish with a fine abrasive article. An alternate method is to finish the entire workpiece with a fine abrasive article thus imparting a fine finish, and then selectively roughening the surface with a coarse abrasive article to provide the rougher section desired.

For example, thin film disks, commonly used in the computer industry, require different area of the disk to have s a fairly consistent surface texture within each respective area for the disk to perform properly. The texture provided on the surface of a thin film disk is a compromise between the surface finish necessary for the memory area versus that necessary for the head landing zone. The landing zone, a ⅛ inch to ⅜ inch (0.32 to 0.95 cm) wide annular ring at the inner diameter of the disk requires a relatively rough finish to minimize the stiction and friction between the disk and the read/write head on startup and shutdown of the drive. The surface roughness of the landing zone preferably has an Ra of about 40 to 60 angstroms. In contrast, the memory retention area of the disk need not be as rough, but is preferred to be about 20 angstroms Ra. The lower Ra minimizes asperities on the disk surface and enables lower flying heights of the read/write head which results in higher recording densities.

In other applications, a sequence of abrasive grades is used to impart the desired finish on a workpiece. A coarser abrasive article is used first to remove any large amounts of stock, after which a finer abrasive article is used to remove undesirable deep scratches from the coarse abrasive article. This step sequence requires the use of several separate grinders or a grinder that can run several abrasive articles simultaneously. This process requires the operator to move the workpiece to a different machine area, either by moving several steps to a different machine, or moving from one side of a machine to another (if it has the capability to run more than one belt at a time). At times, it may even be necessary to change the belt on the grinder due to equipment constraints, which contributes to a significant loss of productive time. What is desired in the field is to have two or more diverse abrasive natures directly next to each other on the same abrasive article so that effort can be saved on the part of the operator and thus productivity improved.

Art of interest in this area is set forth below.

U.S. Pat. No. 449,930 (Dubey) discloses a sandpaper having multiple sections having various kinds of abrasive particles thereon, the sections being divided by grooves devoid of abrasive particles.

U.S. Pat. No. 875,936 (Landis) discloses an abrading material comprising two different grades of abrasive particles applied to a backing in relatively wide and narrow parallel strips or regions arranged alternately with regions devoid of abrasive provided between the strips.

U.S. Pat. No. 4,930,266 (Calhoun) discloses an abrasive article for ophthalmic lens polishing where the surface of the article has abrasive composites comprising binder and abrasive mineral, arranged in a manner so that the outer edge of the article has a higher density of composites than the center.

JP 4-210383 published Jul. 13, 1992 discloses an abrasive tape for the polishing of magnetic recording medium where the hardness of the binder is varied across the width of the tape to produce different surface finishes.

U.S. Pat. No. 5,152,917 (Pieper et al.) discloses an abrasive article comprising precisely shaped structured abrasive composites.

U.S. Pat. No. 5,167,096 (Eltoukhy et al.) discloses an abrasive pad comprising inner and outer regions of different compressibilities which produce a deeper-groove texture at the inner diameter of a computer disk.

EP 0 554 668 (Calhoun) published Aug. 11, 1993, discloses an abrasive article comprising precisely spaced, oriented abrasive composites which comprise abrasive particles dispersed in a binder. Several grades of abrasive particles can be dispersed in each composite, particularly where one grade is above another.

U.S. Ser. No. 08/514,491 (Strecker) filed Aug. 11, 1995, discloses a method of texturing a thin film rigid disk using an abrasive tape wherein the tape has at least two regions of differing abrasive nature. The two regions can be coated in situ, laminated together on a carrier web, or formed by treating the article such as by calendering or flexing.

SUMMARY OF THE INVENTION

This invention relates to a method of making a coated abrasive having multiple abrasive natures, where the multiple abrasive natures are provided by diverse coatings arranged side-by-side and preferably contiguous.

One embodiment of the present invention relates to a method of making an abrasive article comprising a first abrasive coating and a second abrasive coating, said first and second abrasive coatings being in a side-by-side contiguous manner, said first and second abrasive coatings having a first abrasive nature and second abrasive nature, respectively, wherein first abrasive nature is different from said second abrasive nature, said method comprising the steps of:

(a) simultaneously applying a first coating composition curable to provide a first abrasive coating having a first abrasive nature and a second coating composition curable to provide a second abrasive coating having a second abrasive nature different from said first abrasive nature on a front surface of a backing, said coatings being contiguous and nonsuperimposed; and (b) curing said first and second coating compositions to provide said coated abrasive article.

In another further embodiment, the abrasive article formed is a structured abrasive article comprising composites. This method comprises the steps of:

(a) applying a first composite coating composition curable to provide a first composite coating having a first abrasive nature and a second composite coating composition curable to provide a second composite coating having a second abrasive nature different from said first abrasive nature into a plurality of cavities in a production tool by a coating means, wherein said first composite coating and said second composite coating are arranged in a side by side nonspaced manner;

(b) bringing a backing into contact with said composite coating compositions;

(c) curing said first and second composite coating compositions to first and second composite coatings, respectively, wherein each of said composite coatings comprises composites having the inverse shape of said cavities.

And in yet another embodiment, the method comprises the steps of:

(a) applying a composite coating composition onto a front surface of a production tool wherein arranged on said front surface of said production tool are a plurality of cavities arranged in a first region and a second region, said cavities of said first region differing from said cavities of said second region;

(b) bringing a backing in contact with said composite coating composition;

(c) curing said composite coating composition to first and second composite coatings, wherein each of said first and said second composite coatings comprise composites each having the inverse shape of said cavities of said first and second regions, respectively.

The abrasive nature of the coating can be altered by using different size abrasive particles, different types of abrasive particles, lack of abrasive particles, addition of fillers or additives to affect erodability, different binders, different coating patterns, different size or shape of abrasive composites, or a different density of abrasive composites. The abrasive nature can also be altered by changing the ratio of materials in the abrasive coating, or by the processing conditions, e.g., different coating methods, or different degree of cure. It is also possible in certain applications to create an abrasive coating having no abrasive particles or grit therein, that when fully cured, nonetheless functions as a polishing article depending on the hardness of the workpiece and the abrasiveness of the cured binder relative thereto.

The abrasive regions having the abrasive coating or composites therein are preferably in a side by side, contiguous arrangement such that there are no gaps or areas devoid of coating or composites present between adjacent regions, and the adjacent abrasive coatings merge to form a distinct line of demarcation therebetween but without any substantial overlapping of the adjacent coatings. That is, any overlap of the coatings at the merge line is limited to less than 50 micrometers measured in a direction normal to machine direction of the abrasive article. Thus, the term "adjacent" means that the abrasive regions are present next to each other and essentially abutting with each other down the length or width of the abrasive article.

In the present application, "abrasive nature" is defined as the ability to alter a surface of a workpiece. The surface of a workpiece can be altered by the abrasive article in many ways, such as removal of material, reduction or increase of the surface roughness, or imparting a pattern in the topography of the workpiece surface.

A key aspect of this invention is that the process results in an abrasive article having two abrasive natures in a side by side, contiguous, non-superimposed relationship. These two abrasive natures result in a significantly different performance in the abrading of a workpiece. This significant difference in performance can be measured as the amount of workpiece removed in a specified time interval, the amount of pressure or force required to remove a given amount of a workpiece in a given time interval, or the surface finish (Ra) of the workpiece produced by the abrasive article. In general, the term "significantly different abrasive natures" can be measured by one of the above properties. There should be at least a 10% difference in measurement in at least one of these tests. In some instances, the difference may be at least 30%, or even 50%. These tests are made under identical grinding conditions except for the abrasive natures of the abrasive article.

It is also within the scope of the present invention to have an abrasive article having no abrasive particles therein. The abrasive article of this embodiment generally comprises a backing having a plurality of composites, preferably a plurality of precisely shaped composites, adhered to a front surface of the backing, said composites comprising a binder, wherein said composites are essentially free of abrasive particles.

In another embodiment, the abrasive article comprises a backing having a plurality of composites, preferably a plurality of precisely shaped composites, adhered to a front surface of the backing, said composites consisting essentially of binder. More than one binder may be combined to form the binder of the composites.

DETAILED DESCRIPTION OF PREFERRED EMBODIMENTS

Figure 1:
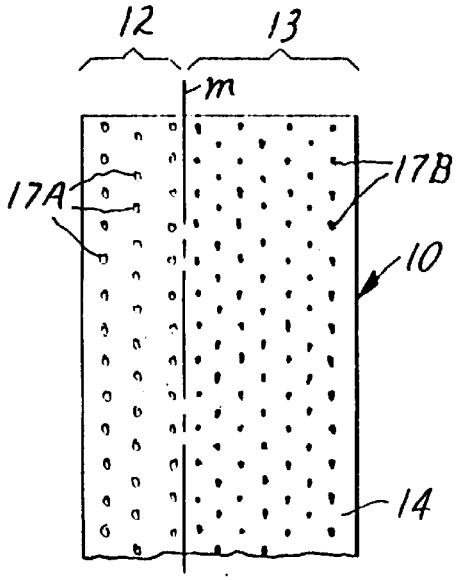
FIG. 1 is a plan view of one embodiment of the abrasive article made by the present invention.

Abrasive articles of this invention generally comprise a plurality of abrasive particles and a binder bonded to a backing. These components, including any additives which may additionally be included, contribute to the abrasive nature of the resulting abrasive product. These additives may be incorporated into the backing as a backsize or pretreatment, incorporated into the binder system or in a layer on top of it, or in or on the abrasive particles per se.

In one mode of the invention, there is a general method of making an abrasive article where a relatively even-surfaced backing is directly coated with the side-by-side, non-spaced diverse abrasive coatings. The coatings are preferably applied simultaneously, but could be applied sequentially.

In an alternate mode of the invention, the diverse abrasive coatings are first, sequentially or preferably simultaneously, coated side-by-side and non-spaced onto a production tool having indentations, or cavities, in a surface thereof which shapes the coatings into three-dimensional abrasive structures and, thereafter, the shaped coatings are transferred to the surface of a relatively even-surfaced backing. The three-dimensional abrasive structures, or composites, can be connected together by directly abutting the bases of each structure, or by a land portion of abrasive material extending between the structures at their bases. As a variation, a single abrasive precursor coating is provided on a backing, after which a pattern is imparted into at least one region of the coating, such that once cured, the region has an abrasive nature different from the other region of the coating.

When it is said that the abrasive coatings are in a side-by-side nonspaced manner in the present invention, it is preferred that the first and second abrasive coatings essentially abut one another in a contiguous manner such that no, or very minimal, gap or absence of abrasive coating exists, i.e., a gap distance less than 50 micrometers (measured in a direction normal to the machine direction). More preferably, any gap is less than 10 micrometers. In addition, it is preferred that the first and second abrasive coatings have minimal overlap or intermixing or intermingling at the interface or merge line. This overlap is less than 50 micrometers in the preferred embodiment of the invention. Preferably there should be a clean, discernible, and fairly straight boundary or line of demarcation between the abrasive coatings. The method of the present invention, quite surprisingly, allows such a clean, nonoverlapping merge line to be formed between adjacent stripes of abrasive material coated on a backing.

The abrasive nature of an abrasive coating can be altered by various methods, such as using different size abrasive particles, different types of abrasive particles, coatings on the abrasive particles, different binders, various patterns in the abrasive coating, and addition of fillers or additives to the binder. The method of coating or curing the abrasive article can also affect the abrasive nature of the abrasive coating as can optional coatings placed either between or on top of the binders. The above-mentioned techniques for varying the abrasive nature of a coating are merely illustrative. The possible methods of varying the abrasive nature of an abrasive coating are not particularly limited. Those of ordinary skill in the art will envision many techniques to vary the abrasive nature of an abrasive coating.

The abrasive particles useful for the current invention typically have a particle size ranging from about 0.1 to 1500 micrometers, usually between about 0.5 to 400 micrometers, and preferably between 1 to 250 micrometers. Examples of abrasive particles include fused aluminum oxide (which includes brown aluminum oxide, heat treated aluminum oxide, and white aluminum oxide), ceramic aluminum oxide, green silicon carbide, black silicon carbide, chromia, alumina zirconia, diamond, tin oxide, iron oxide, ceria, cubic boron nitride, titanium diboride, boron carbide, garnet, and combinations thereof. The abrasive particles will typically have a Mohs' hardness of at least about 7, preferably at least about 8, and most preferably at least about 9. It is within the scope of the invention to have one region of the abrasive article having one abrasive particle type, such as fused aluminum oxide, and the other region having a different or a mixture of abrasive particles, such as ceramic aluminum oxide. Different types of abrasive particles affect the abrasive nature of the abrasive coating.

The abrasive particles have a distribution of particle size associated with them. In many instances, the abrasive particle size distribution is determined by ANSI Standard B74, FEPA 30, 31, and 42, or JIS R6001. In one aspect of this invention, it is preferred that the average particle size (as measured in micrometers) of one abrasive particle distribution is at least 10% greater than the second average abrasive particle size. Sometimes, it is useful when the first average abrasive particle size is at least 20%, or 25%, or even 30% larger than the second average abrasive particle size. Size variations as large as 90% or even over 100% may also be useful depending on the application.

Abrasive particles can also be shaped, for example thin bodies having geometrical faces of triangles, squares, or the like, and filamentary or rod shapes. Examples of shaped abrasive particles are taught in U.S. Pat. Nos. 5,090,968 (Pellow); 5,201,916 (Berg et al.); and 5,304,331 (Leonard et al.).

The term abrasive particle, as used herein, also encompasses single abrasive particles bonded together to form an abrasive agglomerate. Abrasive agglomerates are further described in U.S. Pat. Nos. 4,311,489 (Kressner); 4,652,275 (Bloecher et al.); and 4,799,939 (Bloecher et al.).

It is also within the scope of this invention to have a surface coating provided on the abrasive particles. The surface coating may have many different functions. In some instances the surface coatings increase adhesion to the binder, alter the abrading characteristics of the abrasive particle, and the like. Examples of surface coatings include coupling agents, halide salts, metal oxides including silica, refractory metal nitrides and carbides, and the like.

It is within the scope of this invention that the abrasive nature of the abrasive coating is affected by the abrasive particles, or lack thereof. It has been found that a structured abrasive article, comprising composites of binder, filler, and no abrasive particles, nonetheless is a satisfactory polishing article for relatively soft items such as polycarbonate.

The erodability of the abrasive coating is another property that can be controlled to alter the abrasive nature of the abrasive coating. There are various manners in which the erodability of an abrasive coating can be altered. Generally, filler particles or other additives to the resinous binder are used to alter the erodability of the abrasive coating. Useful additives include fillers (including grinding aids), surfactants, dyes, plasticizers, coupling agents, antistatic agents, and the like.

Examples of fillers used for their effects on erodability include, but are not limited to glass bubbles, alumina bubbles, polymer spheres, clay bubbles, marble, marl, gypsum, chalk, coral, coquina, and oolite. Other examples of useful filler for this invention include: metal carbonates (such as calcium carbonate (chalk, calcite, marl, travertine, marble, and limestone), calcium magnesium carbonate, sodium carbonate, magnesium carbonate), silica (such as quartz, glass beads, glass bubbles, and glass fibers), silicates (such as talc, clays (montmorillonite), feldspar, mica, calcium silicate, calcium metasilicate, sodium aluminosilicate, and sodium silicate), metal sulfates (such as calcium sulfate, barium sulfate, sodium sulfate, aluminum sodium sulfate, and aluminum sulfate), gypsum, vermiculite, wood flour, aluminum trihydrate, carbon black, metal oxides (such as calcium oxide (lime), aluminum oxide, and titanium dioxide), and metal sulfites (such as calcium sulfite). Particularly useful filler additives include amorphous silica, such as commercially available from DeGussa under the trade designation "OX-50" and silica clay, such as commercially available from R. T. Vanderbilt Company, Inc., under the designation "PEERLESS #4.

The term filler also encompasses materials that are known in the abrasive industry as grinding aids. A grinding aid is defined as particulate material that the addition of which has a significant effect on the chemical and physical processes of abrading which results in improved performance. Examples of chemical groups of grinding aids include waxes, organic halide compounds, halide salts and metals and their alloys. The organic halide compounds will typically break down during abrading and release a halogen acid or a gaseous halide compound. Examples of such materials include chlorinated waxes like tetrachloronaphthalene, pentachloronaphthalene; and polyvinyl chloride. Examples of halide salts include sodium chloride, potassium cryolite, sodium cryolite, ammonium cryolite, potassium tetrafluoroborate, sodium tetrafluoroborate, silicon fluorides, potassium chloride, magnesium chloride. Examples of metals include, tin, lead, bismuth, cobalt, antimony, cadmium, iron, and titanium. Other miscellaneous grinding aids include sulfur, organic sulfur compounds, graphite, and metallic sulfides.

Other additives useful in altering the erodability of the abrasive coating include plasticizers such as polyethylene glycol and silicone oil, such as each commercially available from Union Carbide under the trade designations CARBOWAX "600" And SILWET™ "L-7500" or "L77", respectively. Coupling agents added to the abrasive coating also alter the erodability of the coating by enhancing the cross-linking in the coating. Examples of coupling agents include silane coupling agents, such as commercially available from Union Carbide under the trade designations "A-174" and "A-187". Examples of antistatic agents include graphite, carbon black, vanadium oxide, and humectants.

The resinous binder used in the abrasive coating not only comprises the additives to affect the erodability, but the binder itself has an erodability. Examples of typical resinous adhesives include phenolic resins, aminoplast resins, urethane resins, epoxy resins, ethylenically unsaturated resins, acrylated isocyanurate resins, urea-formaldehyde resins, isocyanurate resins, acrylated urethane resins, acrylated epoxy resins, and mixtures thereof.

Phenolic reins are widely used in abrasive article binders because of their thermal properties, availability, cost, and ease of handling. There are two types of phenolic resins, resole and novolac. Resole phenolic resins have a ratio of formaldehyde to phenol, based upon weight, of greater than or equal to one to one, typically between 1.5:1.0 to 3.0:1.0. Novolac resins have a molar ratio of formaldehyde to phenol, based upon weight, of less than one to one. Examples of commercially available phenolic resins include those known by the tradenames "DUREL" and "VARCUM" from Occidental Chemicals Corp., "RESINOX" from Monsanto; and "AROFENE" And "AROTAP" from Ashland Chemical Co.

Aminoplast resins have at least one pendant alpha, beta-unsaturated carbonyl group per molecule or oligomer. There materials are further described in U.S. Pat. Nos. 4,903,440 (Larson et al.) and 5,236,472 (Kirk et al.), both incorporated herein by reference.

Epoxy resins have an oxirane and are polymerized by the ring opening. Such epoxide resins include monomeric epoxy resins and polymeric epoxy resins. The resins can vary greatly in the nature of their backbones and substituent groups. For example, the backbone may be of any type normally associated with epoxy resin, and the substituent groups thereon can be any group free of an active hydrogen atom that is reactive with an oxirane ring at room temperature. Representative examples of acceptable substituent groups include halogens, ester groups, ether groups, sulfonate groups, siloxane groups, nitro groups, and phosphate groups. Examples of some preferred epoxy resins include 2,2-bis[4-(2,3-epoxypropoxy)-phenyl]propane (diglycidyl ether of bisphenol) and commercially available materials under the trade designation "EPON 828", "EPON 1004", and "Epon 1001F" available from Shell Chemical Co., and "DER-331", "DER-332", and "DER-334" available from Dow Chemical Co. Other suitable epoxy resins include glycidyl ethers of phenol formaldehyde novolac (e.g., "DEN-431" and "DEN-428" available from Dow Chemical Co.).

Ethylenically unsaturated resins include both monomeric and polymeric compounds that contain atoms of carbon, hydrogen, and oxygen, and optionally, nitrogen, and the halogens. Oxygen or nitrogen atoms or both are generally present in ether, ester, urethane, amide, and urea groups.

Ethylenically unsaturated compounds preferably have a molecular weight of less than about 4,000 and are preferably esters made from the reaction of compounds containing aliphatic monohydroxy groups or aliphatic polyhydroxy groups and unsaturated carboxylic acids, such as acrylic acid, methoacrylic acid, itaconic acid, crotonic acid, isocrotonic acid, maleic acid, and the like. Representative examples of acrylate resins include methyl methacrylate, ethyl methacrylate, styrene, divinylbenzene, vinyl toluene, ethylene glycol diacrylate, ethylene glycol methoacrylate, hexanediol diacrylate, triethylene glycol diacrylate, trimethylolpropane triacrylate, glycerol triacrylate, pentaerythritol triacrylate, pentaerythritol methoacrylate, pentaerythritol tetraacrylate, and pentaerythritol tetraacrylate. Other ethylenically unsaturated resins include monoallyl, polyallyl, and polymethallyl esters and amides of carboxylic acids, such as diallyl phthalate, diallyl adipate, and N,N-diallyladipamide. Still other nitrogen containing compounds include tris(2-acryloyl-oxyethyl)isocyanurate, 1,3,5-tri(2-methylacryloxyethyl)-s-triazine, acrylamide, methylacrylamide, N-methylacrylamide, N,N,-dimethylacrylamide, N-vinylpyrrolidone, and N-vinylpiperidone.

Acrylated urethanes are diacrylated esters of hydroxy terminated NCO extended polyesters or polyethers. Examples of commercially available acrylated urethanes include "UVITHANE 782" available from Morton Thiokol Chemical, and "CMD 6600", "CMD 3500", "CMD 3600", and "CMD 3700" available from Radcure Specialties.

Bismaleimide resins are further described in U.S. Pat. No. 5,314,513 (Miller et al.).

Coated abrasive backings generally involve a sheet-like structure having a front and a back side, with the front side being available for accepting the abrasive coating. Examples of typical abrasive backings include polymeric film (including primed polymeric film), cloth (including greige cloth), paper, vulcanized fiber, thermoplastics, nonwovens, metal (including metal substrates, metal foils, and the like), and treated versions thereof, and combinations thereof. Other examples of backings are described in U.S. Pat. No. 5,316,812 (Stout et al.) and WO 93/12911 (Benedict et al.). The backing may contain a backing treatment, such as a primer, presize, backsize, and/or saturant. Alternatively, the backing may be devoid of any backing treatment.

The abrasive article of the present invention can be in any known form, such as a sheet, tape, or endless belt.

A known method of producing a coated abrasive, known as a slurry coated abrasive, is to provide a slurry of binder precursor and abrasive particles. This slurry is a dispersion of the abrasive particles in the binder precursor. The abrasive particles, and any fillers (including additives, dyes, surfactants, etc.) are mixed into the binder precursor to form a homogenous slurry. It is sometimes preferred to use a vacuum during mixing to prevent any undesirable air entrapment. Slurries can be coated on a backing by a variety of methods, including gravure roll coating, curtain coating, die coating (also known as slot-fed knife coating), and knife coating. A preferred method of producing a slurry coated abrasive article of the present invention is to coat the individual slurries simultaneously, using an applicator means and a reservoir means.

The applicator means functions to apply the abrasive slurry such that an abrasive precursor coating is formed on a backing.

The reservoir means functions to temporarily store and physically separate the abrasive slurries until the slurries are contacted by the applicator means. The reservoir means should have at least two compartments, one for each abrasive slurry. The compartments of the reservoir means should effectively store and physically separate the abrasive slurries from each other until the slurries pass under the applicator means.

As stated above, various applicator means are known which can be used in this invention. For a die, or slot-fed knife, coating apparatus, the die portion can be considered a applicator means, and the manifold can be considered a reservoir means. For a gravure coater, the gravure roll can be considered a applicator means, and the tray for containing the abrasive slurry can be considered a reservoir means. For a knife coater, the preferred applicator means for the present invention, the knife blade can be considered a applicator means and the dam used for containing the abrasive slurry can be considered a reservoir means. It is also foreseen that the abrasive slurries can be extruded or cast, and thus, those coating means would also comprise a applicator means and a reservoir means.

Figure 4A:
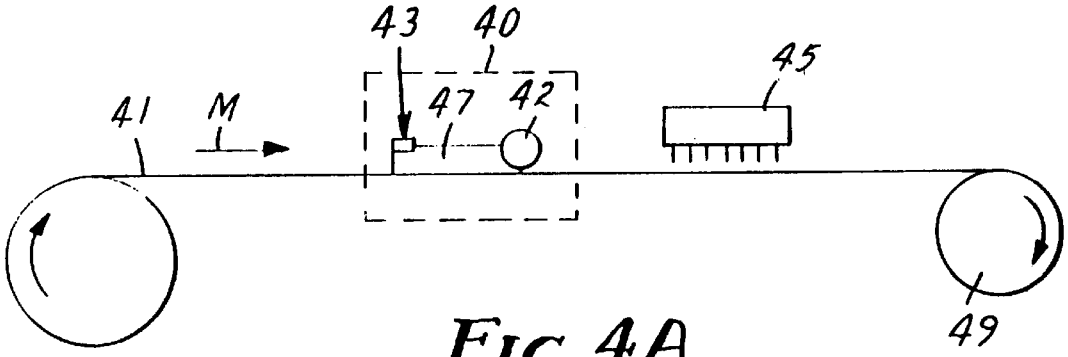
FIG. 4A is a side schematic of a system for practicing the method of the present invention.
Figure 4B:
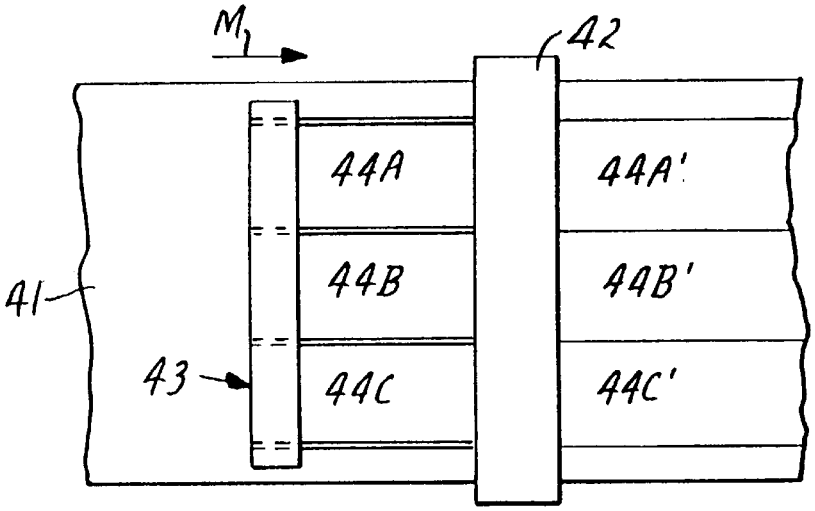
FIG. 4B is an enlarged top view of a coating means outlined by dotted lines in FIG. 4A as used by the process depicted in FIG. 4A.

To illustrate the general embodiment of the invention involving direct coating of a backing with the diverse abrasive coating slurries, attention is directed to FIGS. 4A and 4B.

FIG. 4B is an enlarged top view of a coating means 40 comprising a applicator means 42 and a reservoir means 43 as depicted in the system of FIG. 4A within the dotted lines. In FIGS. 4A and 4B coating means 40 comprises applicator means 42 and reservoir means 43 having compartments A, B, C. Applicator means 42, shown in FIG. 4A as a knife blade, rests at its lower terminus in close proximity to backing 41 which has a machine direction shown as M. Directly upweb from applicator means 42 is reservoir means 43, shown here as a dam. As better seen in FIGS. 4B and 5, reservoir means 43 has three compartments A, B and C which temporarily store and physically separate abrasive slurries 44A, 44B, and 44C, once abrasive slurries 44A, 44B, and 44C are introduced to the reservoir means. The three compartments are aligned normal to the machine direction M of backing 41. Reservoir means 43 sealingly contacts applicator means 42 such that minimal abrasive slurry escapes from each respective compartment. During the production process, backing 41 carries abrasive slurries 44A, 44B, and 44C from reservoir means 43 beneath applicator means 42 to form abrasive precursor coatings 44A', 44B', and 44C' in the form of thin, uniform coatings on the side emerging from applicator means 42. These binder precursor coatings pass under curing means 45 and the abrasive article is collected on take-up reel 49. Depending on the type of binder employed, curing means 45 can be selected to emit actinic radiation or thermal radiation, for example.

Figure 5:
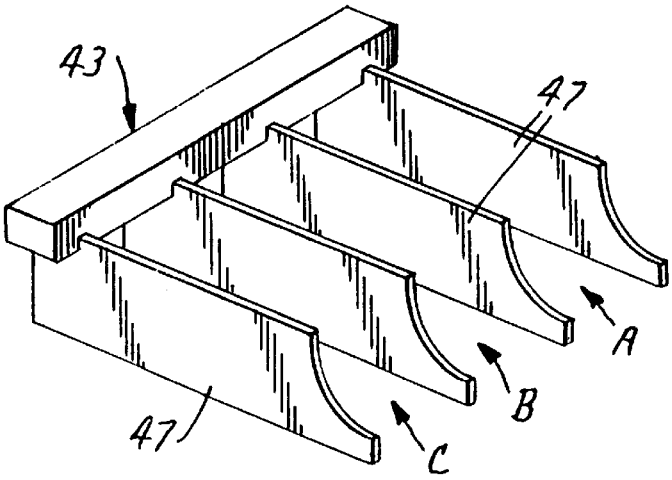
FIG. 5 is a side perspective view of a reservoir means suitable for use by the method of the present invention.

FIG. 5 is an isolated side perspective view of reservoir means 43 of FIGS. 4A and 4B. Reservoir means 43 has three compartments A, B, and C defined by baffles 47 which temporarily store and physically separate the abrasive slurries within reservoir means 43 until the abrasive slurries are contacted by applicator means (not shown here). Crosspiece 48 fastens the baffles 47 into position.

In one embodiment of the invention, the abrasive natures of the abrasive coatings differ by virtue of the differences between average abrasive particle size used in the abrasive slurries. Preferably, the average particle size (in micrometers) for the abrasive particles in different slurries differs by at least 10%, preferably 20%, and more preferably by at least 25%.

FIG. 1 shows abrasive article 10 made by the method of the present invention having backing (not shown) on which abrasive coatings 12 and 13 are formed by the method of the invention. Abrasive coatings 12 and 13 comprise a binder 14 and a plurality of abrasive particles 17A and 17B. Abrasive coating 12 comprises abrasive particles 17A having an average particle size (in $\mu$m) at least 10% greater than the average particle size of the abrasive particles 17B in coating 13. The abrasive nature of abrasive coating 12 is greater than the abrasive nature of coating 13 because of the difference in average abrasive particle size. The coatings 12 and 13 meet at merge line "m".

To produce the abrasive article by the embodiment of the present invention where the abrasive natures of the abrasive coatings differ by virtue of the average particle size of the abrasive particles, at least two particle size distributions, having the average particle size (in $\mu$m) of one distribution at least about 10% larger than the other distribution, are used. The size distributions of the abrasive particles can be wide or narrow, and it is not necessary that the distributions be of a nominal grade (i.e., FEPA, ANSI, JIS, P-grade, etc.), although it is preferred that there be no extraneously large or small abrasive particles which may contribute to scratching or loading, respectively. In general, the average particle size (in $\mu$m) of one distribution will be at least 10%, preferably at least 20%, more preferably at least 25% larger than the average particle size of the distribution of the adjacent abrasive coating region. In some abrading applications, it is preferred that the average abrasive particle size (in $\mu$m) of one abrasive coating be at least about 30%, even 50% larger than the average abrasive particle size for the adjacent abrasive coating.

It is preferred that the abrasive coatings directly adjoin one another, such that no gap (void), or very minimal gap, of coating exists. The abrasive coatings should generally be in a side by side nonspaced manner. It is possible to have some intermixing between the abrasive coatings (and thus the abrasive natures), but this is generally undesirable because the surface finish produced by that area may be unpredictable. It is also possible to have more than two, such as three or four or even more, different abrasive particle size distributions, and thus this many abrasive coatings, side by side. It is not necessary that for three or more different distributions, the arrangement of the abrasive coating is in any particular order (i.e., increasing or decreasing in size across the width of the article).

Some methods of discerning one abrasive-natured coating from another, not just for composites but for all abrasive articles of the invention, are by use of slurry pigment, composite shape, composite spacing, abrasive particle shape, abrasive particles type, coating weight, and so forth, with pigmentation being the easiest to administer and discern.

It is desired that there be a minimal amount of overlap or intermixing between the two abrasive composite coating regions. It is preferred that the at least two abrasive coating regions, having different abrasive natures, have a clean and discernible boundary. Any area where two abrasive coating regions meet or overlap can produce an unpredictable surface finish on the workpiece which is usually undesirable. It is also preferred that the interface of two abrasive coating regions be straight and linear. In addition to a clean merge line, the abrasive coatings should be in a side by side unspaced manner. The area devoid of abrasive coating should be minimized, preferably less than 50 micrometers, more preferably less than 10 micrometers.

The area devoid of abrasive coating generally should be minimized to help reduce the tendency of the abrasive article folding or creasing at that point. Areas devoid of abrasive coating are generally seen to be more flexible and have a higher tendency to crease, usually reducing the usefulness of the abrasive article.

In another aspect of the invention, the abrasive coating of the abrasive article is in the form of a plurality of abrasive composites bonded to a backing, such as taught by U.S. Pat. Nos. 5,152,917 and 5,304,223 (Pieper et al.) and 5,435,816 (Spurgeon et al.). The abrasive composites comprise abrasive particles and a binder. It is generally preferred that each abrasive composite has a precise shape associated with it. The precise shape is determined by distinct and discernible boundaries. These boundaries form the outline or contour of the precise shape, and to some degree separate one abrasive composite from another. The composites are usually formed by filling cavities in a production tool with an abrasive slurry comprising abrasive particles and binder precursor, and then curing the binder precursor while in the production tool, such that the cured composite has the inverse shape of the cavity. A plurality of these abrasive composites provides an abrasive article known as a structured abrasive article. The individual composites are generally interconnected by abutting each other at their bases, or via a land portion or abrasive material formed at the bases of the composites. Such a land portion is depicted in FIG. 3.

When the abrasive coating is in the form of a structured abrasive coating comprising abrasive composites, the abrasive nature of the abrasive coating can be varied by varying the composites in addition to the use of different size and type of abrasive particles (including absence of abrasive particles), different binders, and fillers within the composites. The composites can be varied by size or height, shape of abrasive composites, or density of abrasive composites, and so forth in order to produce a different abrasive nature.

Figure 2:
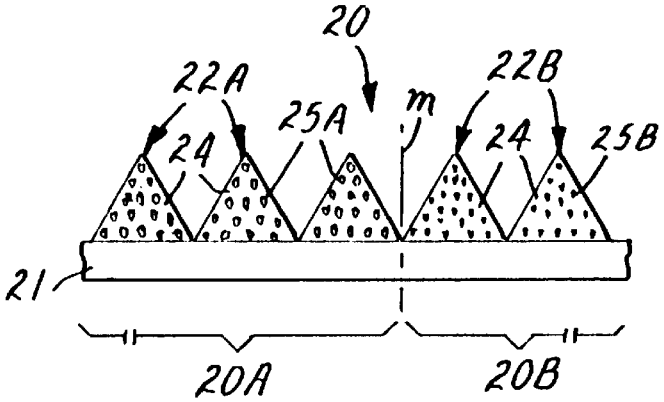
FIG. 2 is a cross-sectional side view of another embodiment of the abrasive article made by the present invention.

FIG. 2 shows abrasive article 20 made by this embodiment of the present invention having backing 21 and two diverse abrasive coatings comprising a plurality of abrasive composites 22A and 22B, respectively. Abrasive composites 22A and 22B comprise binder 24 and abrasive particles 25A and 25B, respectively. The abrasive coatings 20A and 20B meet at merge line "m" without overlap. Abrasive particles 25A are at least about 10% larger in average particle size (in $\mu$m) than abrasive particles 25B. The composites 22A and 22B are depicted as having the same overall dimensions, but it is feasible that the heights of the composites could vary from one grade to the other, as could the shape of the composites. The point at which abrasive composites 22A and 22B meet is seen in FIG. 2 as a point on the merge line (shown as "m" in FIG. 1). Here, in structured abrasive article 20, the merge line should separate abrasive coatings 20A and 20B in a generally abutting side by side nonspaced, non-overlapping manner throughout the abrasive article.

Figure 3:
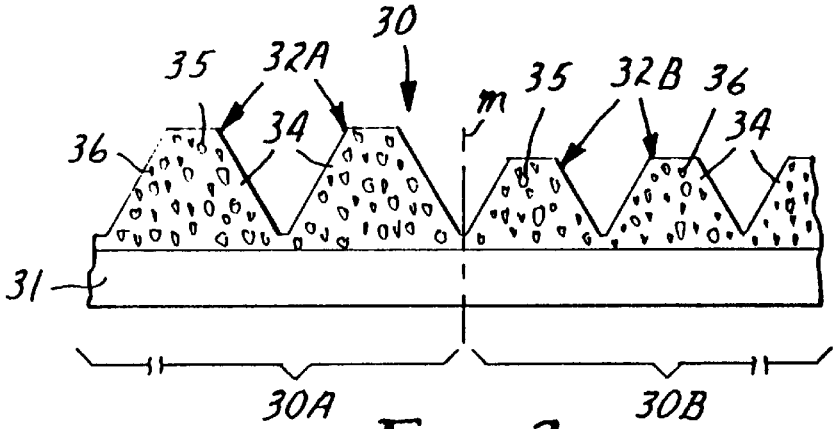
FIG. 3 is a cross-sectional side view of yet another embodiment of the abrasive article made by the present invention.

FIG. 3 shows another abrasive article 30 made by this embodiment of the present invention having backing 31 and two abrasive coatings 30A and 30B comprising a plurality of abrasive composites 32A and 32B respectively. Abrasive composites 32A and 32B, comprise binder 34, abrasive particles 35, and filler particles 36. Abrasive composites 32A are taller in height and wider at the base than abrasive composites 32B, although abrasive particles 35 are of the same particle size distribution and same abrasive particle type throughout. Filler particles 36 can be chosen so as to affect the erodability of the abrasive composites as desired, although in this depiction filler particles 36 are the same for abrasive coatings 30A and 30B. The two abrasive coatings 30A and 30B comprising composites 32A and 32B, respectively, meet at merge line "m."

A variation of FIG. 3 can be obtained by imparting a pattern on one region of an abrasive article to form a topography. It is not necessary that the pattern imparted be exact and precise, but may be random and irregular, as may the abrasive composites forming the topography. Examples of methods of providing a pattern include a patterned gravure roll, combs, stamps, etc. Drying patterns (often known as Bernard cells), caused by the evaporation of solvent from the abrasive precursor coating, are known to alter the abrasive nature of a coating. Such drying patterns are believed to depend on airflow and heating conditions during thermal cure.

The preferred method to make a structured coated abrasive is described in U.S. Pat. Nos. 5,152,917 and 5,304,223 (Pieper et al.) and 5,435,816 (Spurgeon et al.), all incorporated herein by reference. One method involves 1) introducing an abrasive slurry onto a production tool, wherein the production tool has a specified pattern, 2) introducing a backing to the outer surface of the production tool such that the slurry wets one major surface of the backing to form an intermediate article; 3) at least partially curing or gelling the resinous adhesive before the intermediate article departs from the outer surface of the production tool to form a lapping coated abrasive article; and 4) removing the coated abrasive article from the production tool. Another method involves 1) introducing an abrasive slurry onto the backing such that the slurry wets the front side of the backing to form an intermediate article; 2) introducing the intermediate article to a production tool having a specified pattern; 3) at least partially curing or gelling the resinous adhesive before the intermediate article departs from the outer surface of the production tool to form a lapping coated abrasive article; and 4) removing the lapping coated abrasive article from the production tool. In these two methods, the resulting solidified abrasive slurry or abrasive composite will have the inverse pattern of the production tool. By at least partially curing or solidifying on the production tool, the abrasive composite has a precise and predetermined pattern. The resinous adhesive can be further solidified or cured off the production tool.

Figure 6:
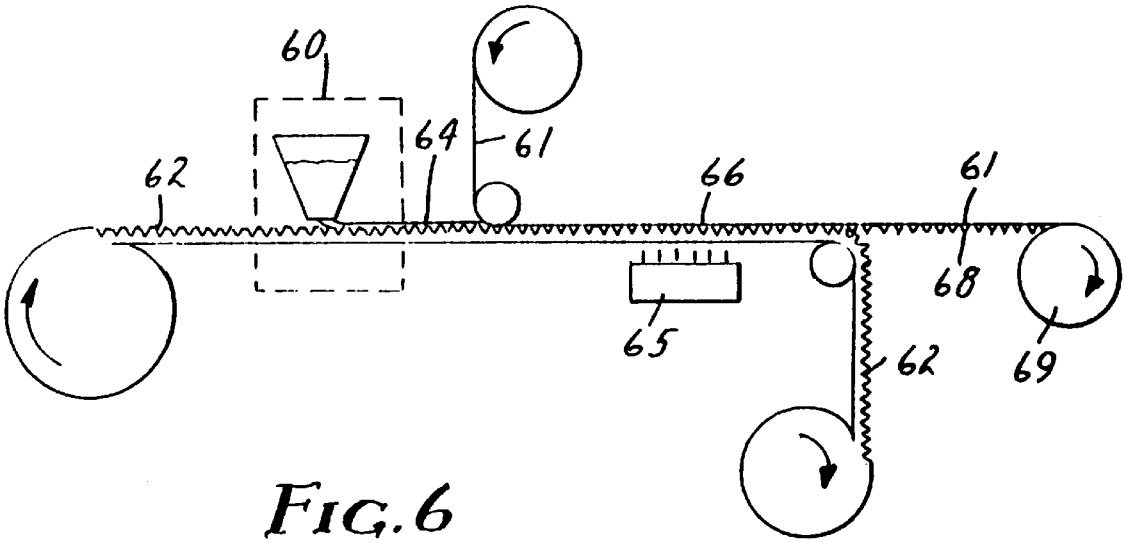
FIG. 6 is a side schematic of another system for practicing the method of the present invention.

FIG. 6 is a schematic of the third embodiment of the present invention. Production tool 62 having cavities therein is coated with an abrasive slurry by a coating means 60, in this case, a die coater. Coating means 60 comprises a applicator means (not depicted) and a reservoir means (not depicted). The abrasive slurry comprises abrasive particles and binder precursor, as is generally known in the abrasives art. Coating means 60 is capable of applying at least two abrasive slurries simultaneously in a side by side nonspaced, not overlapping manner. In FIG. 6, the abrasive slurry is applied via coating means 60 to the cavities of production tool 62 to form an abrasive precursor coating 64. Backing 61 is brought into contact with production tool 62 and abrasive precursor coating 64. Curing means 65 affects abrasive precursor coating 64 through production tool 62 to form abrasive coatings 66, each comprising abrasive composites. Abrasive coating 66 is removed from production tool 62 so that abrasive article 68 is formed, which is collected by wind-up on storage roll 69.

The abrasive article 68 has at least two side-by-side, nonspaced abrasive coatings 66, although not visible in the view of FIG. 6. Each abrasive coating has an abrasive nature that differs from the adjacent abrasive coating. The at least two abrasive coatings are produced from at least two abrasive slurries which are simultaneously coated by coating means 60.

In an alternate method, such as to provide the abrasive article shown in FIG. 3, a single abrasive slurry is applied via coating means 60 to the cavities of production tool 62, where production tool 62 has regions having varying cavities.

The coating means arrangement illustrated in FIGS. 4 and 5 is equally suitable for the embodiment where the production tool is directly coated before transfer of the abrasive coatings to a backing. Coating means 40 comprising applicator means 42 and reservoir means 43 is in direct contact with production tool 62 in lieu of backing 41.

It is generally necessary that reservoir means 43 directly contacts backing 41 or production tool 62 in order to temporarily store and physically separate the various abrasive slurries so that there is no intermixing before the abrasive slurries contact the applicator means. Reservoir means 43 also generally contacts applicator means 42 at its approach side facing the abrasive slurries as to reduce any undesired cross mixing of abrasive slurries.

In a further embodiment, the abrasive article of the present invention can be in the form of a tape having an extended length mounted in a dispenser, wherein the dispenser is capable of cutting the abrasive article to a length shorter than the extended length. Various types of dispensers are useful, particularly dispensers similar to those used in the dispensing of articles such as cellophane tape. The dispenser comprises a means to support the abrasive tape and a means to cut the tape. Examples of cutting means include serrated teeth, a continuous blade, or a sharp edge. Preferably, the abrasive article or abrasive tape has a score line or a break in the abrasive coating in order to facilitate the cutting of the article. For structure coated abrasives, a score line or break can readily be produced by using a production tool having the score line imparted into the cavity pattern of the tooling. This configuration allows for the abrasive article to be easily dispensed from a supply roll and then cut to a desired length.

Figure 7:
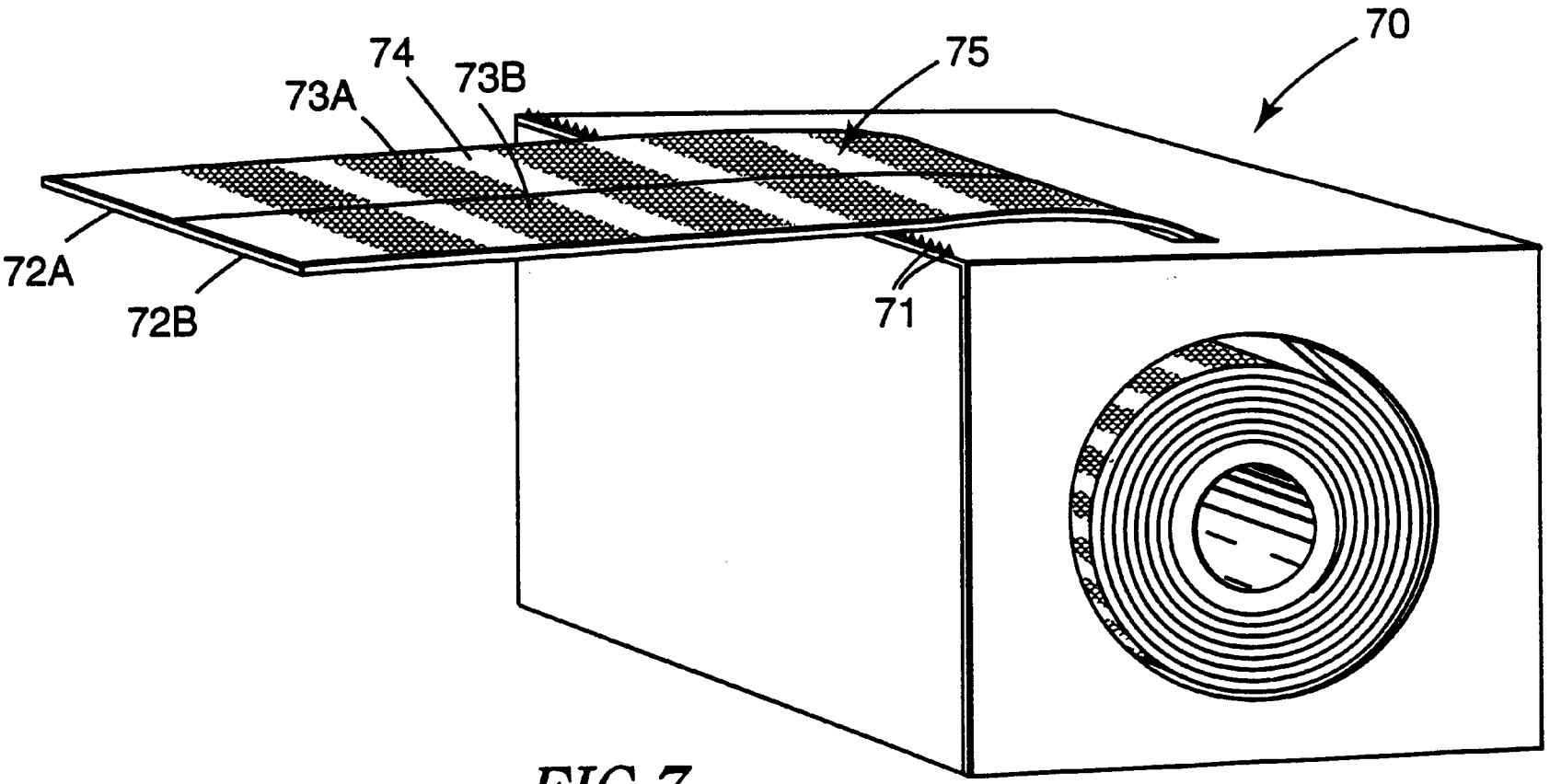
FIG. 7 is a side perspective view of a dispensing means for an abrasive article of the present invention.

FIG. 7 shows dispenser 70 comprising cutting means 71, here serrated teeth. Abrasive article 75, showed as a roll inside dispenser 70, has abrasive regions 72A and 72B comprising a plurality of abrasive composites 73A and 73B, respectively, and void area 74. The abrasive nature of abrasive region 72A is different than the abrasive nature of abrasive region 72B. Abrasive article 75 can be indexed such that cutting means 71 cuts abrasive article 75 at void area 74.

The abrasive article of the present invention can be used to abrade any number of workpiece types. Examples of workpieces include rolls, thin film disks for magnetic media storage, automotive side panels, eyeglass lenses, wood panels, and the like. The abrasive article of the present invention having at least two regions of abrasive nature can be used to simultaneously impart various surface finishes on the workpiece. For example, a roll needing a finer surface finish on one end than on the other, can be abraded with a single article of the present invention by bringing the abrasive article into contact with the roll and abrading without traversing the article across the workpiece to provide the two surface finish regions. Alternately, if a single surface finish is desired, the grinding or abrading can be done sequentially, whereby the region of the abrasive article having the higher or coarser abrasive nature is used first to remove large amounts of workpiece material, and then the region having the less coarse abrasive nature is used to refine and remove scratches left by the coarse region.

In another aspect of the invention, the abrasive article comprises a flexible backing having a front surface and a plurality of composites bonded to said front surface, wherein said composites consist essentially of a binder, wherein said binder is sufficiently cured so as to impart an abrasive nature to said composites. In another embodiment, the composites consist essentially of binder and filler particles.

It is preferred that the backing on which the composite are adhered is flexible. "Flexible" is defined as the ability to bend and conform. Preferably, the backing is capable of being flexed, bent, and conformed repeatedly without any damage or permanent deformation to the backing. Examples of backings are listed above, and preferred backings include cloth, paper, and polymeric film.

The composites of the abrasive article of this aspect of the invention are essentially free of abrasive particles. The binder of the composites and any fillers and/or additives, if any, that removes workpiece material and refines the surface finish; abrasive particles are not responsible for the performance of the article.

The binder may be selected from any known binder which is curable to provide a composite having an abrasive nature. Examples of usable binders are discussed in detail above. Preferably, no abrasive particles are present in the article of the present embodiment. However, filler particles and other additives may be present in the composites.

The composites of the article of this embodiment optionally comprise fillers, in particular filler particles. Fillers are generally added to composites to control the erodability and breakdown of the composite. Fillers generally have a Mohs' hardness less than about 7, typically less than about 6, and in some instances less than about 5. The average particle size of the filler particles can range from about 0.1 to about 50 micrometers, preferably between 1 and 25. The term filler also encompasses grinding aids. Usable fillers and grinding aids are described in detail above. Generally, the binder to filler ratio can be from 100:0 to 1:2, preferably 49:1 to 1:1. The amount of filler is generally selected so as to provide a workable viscosity to the slurry, and to produce a composite which produces the desired abrading or polishing performance. For example, filler particles can be selected to increase the strength and hardness of the binder materials which comprise the composites. Filler particles can also be selected to affect the erodability of the composites.

Other additives can also be included in the composites of this embodiment. Examples of additives include photoinitiators, wetting agents, and antistatic agents, as described above. Additives such as these are generally used at levels from about 0.1% to 5% of the composite weight. Plasticizers are known to be used at levels up to, and over, 40% of the total composite. Additives such as these are generally in the liquid form, and are considered to be part of the binder. For example, a composite consisting of 48 parts acrylate, 1 part photoinitiator, and 1 part plasticizer, is considered to be 100% binder.

An article comprising composites which are essentially free of abrasive particles is useful for many polishing and buffing applications. Such an article will generally be useful on any workpiece which is softer than the composite. However, it has been discovered that an abrasive article of the present invention can also either remove material from, or refine the surface of a workpiece which is harder than the composites and their binder make-up.

Articles according to this aspect of the invention can be used to polish a wide range of workpiece surfaces. These workpiece surfaces include metal (including mild steel, carbon steel, stainless steel, gray cast iron, titanium, aluminum and the like), metal alloys (copper, brass and the like), exotic metal alloys, ceramics, composites, glass, wood (including pine, oak, maple, elm, walnut, hickory, mahogany, cherry and the like), wood-based materials (including particle board, plywood, veneers and the like), painted surfaces, plastics (including thermoplastics and reinforced thermoplastics), stones and gems (including jewelry, marble, granite, and semi precious stones), magnetic media (including rigid disc texturing, floppy discs and the like), and the like. The workpiece may be flat or may have a shape or contour associated with it.

Examples of specific workpieces include ophthalmic lenses, glass television screens, metal engine components (including cam shafts, crankshafts, engine blocks and the like), hand tools metal forgings, fiber optic polishing, caskets, furniture, wood cabinets, turbine blades, painted automotive components, magnetic media and the like.

Articles according to this aspect of the invention may be useful for polishing glass surfaces including glass television screens, eye glass lenses, glass ophthalmic surfaces, windows (including home windows, office windows, car windows, air windows, train windows, bus windows and the like), glass display shelves, mirrors and the like.

Depending upon the particular polishing application, the force at the abrading interface can range from about 0.01 kg to over 100 kg, typically between 0.1 to 10 kg. Also depending upon the application, there may be a polishing liquid present at the interface between the abrasive article and the workpiece. This liquid can be water and/or an organic solvent. The polishing liquid may further comprise additives such as lubricants, oils, emulsified organic compounds, cutting fluids, soaps and the like. The article may oscillate at the polishing interface during use.

The article of the invention can be used by hand or used in combination with a machine. For example, the article may be secured to a random orbital tool or a rotary tool. At least one or both of the article and the workpiece is moved relative to the other.

The article can be converted to any shape or size of sheet good, such as discs, sheets, tape (i.e., continuous length roll), and belts. In some instances, the article may be an endless belt. Endless belts are well known in the abrasives art, and are typically made by joining two free ends of an elongate strip of material by means of a splice so that an endless belt is formed. Belts are generally used on power driven grinders and machines. Typical belt speed are 500–7000 surface feet per minute (152–2133 meters/min), with loads from 0.1–500 kg (preferably 1–100 kg).

If the article does move relative to the workpiece, then the article can move in any desired fashion and this depends largely in part upon the particular polishing application. For example, the article can transit in a back and forth fashion, rotary fashion, circular fashion, spiral fashion, elliptical fashion or a random motion fashion. Additionally the article can oscillate and/or vibrate during polishing.

The workpiece may remain stationary during polishing or alternatively, the workpiece may move relative to the article during polishing. If the workpiece does move relative to the article, then the article can move in any desired fashion and this depends largely in part upon the particular polishing application. For example, the workpiece can transit in a back and forth fashion, rotary fashion, circular fashion, spiral fashion, elliptical fashion or a random motion fashion. Additionally the workpiece can oscillate and/or vibrate during polishing.

Objects and advantages of this invention are further illustrated by the following examples, but the particular materials and amounts thereof recited in these examples, as well as other conditions and details, should not be construed to unduly limit this invention.

EXAMPLES

The following non-limiting examples will further illustrate the invention. All parts, percentages, ratios, etc., in the examples are by weight unless otherwise indicated. The following abbreviations are used throughout:

| | |
|---|---|
| ASF | amorphous silica filler, commercially available from DeGussa under the trade designation "OX-50"; |
| AEF | amorphous silica filler, commercially available from DeGussa under the trade designation "AEROSIL 130"; |
| KBF4 | potassium tetrafluoroborate; |
| PH2 | 2-benzyl-2-N,N-dimethylamino-1-(4-morpholinophenyl)-1-butanone, commercially available from Ciba Geigy Corp. under the trade designation "IRGACURE 369"; |
| SCA | silane coupling agent, 3-methacryloxypropyl-trimethoxysilane, commercially available from Union Carbide under the trade designation "A-174"; |
| SCA2 | silane coupling agent, gamma-glycidoxypropyl trimethoxysilane, commercially available from Union Carbide under the trade designation "A-187"; |
| TATHEIC | triacrylate of tris(hydroxy ethyl)isocyanurate; |
| TMPTA | trimethylol propane triacrylate; |
| FAO | fused aluminum oxide; |
| WAO | white aluminum oxide; |
| MEK | methyl ethyl ketone; |
| TOL | toluene; |
| PR3 | polyester resin, commercially available from Shell Chemical Co. under the trade designation "3300"; |
| SSC | sodium diamylsulfosuccinate, commercially available from American Cyanamid under the trade designation "AEROSOL AY100"; |
| POL | polyol, commercially available from Monsanto under the trade designation "RJ00"; |
| TDI | polyisocyanurate of toluene diisocyanate commercially available from Miles under the trade designation "DESMODUR IL"; |
| CAT | dibutyl tin dilaurate, commercially available from Cardinal Chemical Co. under the trade designation "D-22". |

Procedure for Making a Structured Abrasive Article Having Abrasive Composites

The following general procedure, from the teachings of U.S. Pat. Nos. 5,152,917 (Pieper et al.) and 5,435,816 (Spurgeon et al.), both incorporated herein by reference, was used for making the structured abrasive examples. First, an abrasive slurry, comprising a binder precursor, was prepared by thoroughly mixing the raw materials as listed. All of the ratios are based upon weight. The abrasive slurry was coated at a speed of about 236 cm/minute with a knife coater using a 76 micrometer gap onto a production tool having a pyramidal type pattern such that the abrasive slurry filled recesses in the tool. The pyramidal pattern was such that no two adjacent composites had the same shape. This pattern, and its manner of being made, is described in WO 95/07797, incorporated herein by reference. The 355 micrometer high pyramids had four sides (excluding the base) and their bases butted up against one another. Next a rayon cloth backing, approximate weight 230 g/m$^2$ was pressed against the filled cavities of the production tool by means of a roller and the abrasive slurry wetted the front surface of the rayon cloth. The rayon cloth had a phenolicilatex presize to seal the cloth. UV/visible radiation, at a dosage of about 236 Watts/cm (600 Watts/inch) produced by 2 "D" bulbs, available from Fusion Systems, was transmitted through the tooling and into the abrasive slurry. The UV/visible radiation initiated the polymerization of the binder precursor and resulted in the abrasive slurry, also known as the abrasive precursor coating, to be transformed into an abrasive composite with the abrasive composite being adhered to the cloth substrate. Next, the abrasive composite construction was separated from the production tool to form an abrasive article.

Procedure for Making a Lapping Abrasive Article

The following general procedure was used for making the lapping abrasive examples. First, an abrasive slurry, comprising a binder precursor, was prepared by thoroughly mixing the raw materials as listed. All of the ratios are based on weight. The abrasive slurry was coated onto a backing with a knife coater having a 51 micrometer gap between the knife and the backing. A dividing dam having two compartments was placed behind (upweb from) and in contact with the knife, and the abrasive slurries were poured into the compartments of the dam. The abrasive slurries were physically separated by the dam until they came into contact with the knife. The backing was pulled in the machine direction and the abrasive slurries passed under the knife and abrasive precursor coatings were formed. The abrasive precursor coatings, were then cured by placement in a forced oven at 120° C. for 5 minutes followed by 50° C. for 16 hours to form the abrasive coatings.

Test Procedure I

For Test Procedure I, the abrasive article was converted to a 7.6 cm by 335 cm endless belt and tested on a constant load surface grinder. A stainless steel golf club head was mounted in a holder. The belt was mounted over a contact wheel (Matchless Diamond Cross Cut Type A, 7.6 cm by 35.5 cm) and was rotated at about 2285 meters per minute. The golf club head was ground while manually being held by the operator. First, the region of the abrasive belt having the coarser abrasive nature was used to remove large amounts of material and any flashing that remained. Next, the region having the finer abrasive nature was used to remove any scratches left in the club head by the coarser region. No lubricant or coolant was used.

Test Procedure II

For Test Procedure II, the abrasive article was converted into a tape, 10 cm wide, having a 5 cm wide region of each of two abrasive coatings, wherein the abrasive nature of the two coatings was different. The tape was fed at a speed of 1.27 meters/second (250 surface feet per minute) against a 1018 mild steel 7.6 cm (3 inch) diameter roll. The pressure between the abrasive tape and the roll was 6.89 kN/m$^2$ (35 psi) The finish on the roll, before each test, was 5 microinches (0.127 micrometers) Ra.

Test Procedure III

For Test Procedure III, the abrasive article was converted into a tape, 3.5 cm (1.37 inches) wide having an extended length. Rolls of the abrasive article were installed on a tape cassette that had a supply reel with the unused abrasive tape and a take-up reel with the used abrasive article; two cassettes consisted of a set. The cassette set was installed on a model 800C HDF Disk Burnisher, manufactured by Exclusive Design Co., (San Mateo, Calif.). One cassette was used to texture the top surface of a thin film rigid disk, and the other cassette was used to texture the bottom surface of the disk. The thin film disk substrate was a nickel/phosphorus (NiP) plate aluminum disk (95 mm diameter) which rotated at 200 rpm. The feed rate of the abrasive tape was 30.5 cm/min. During the texturing process, an aqueous coolant mist was dripped onto a cleaning fabric which was applied to the surface of the disk to transfer the aqueous coolant to the surface of the disk. At the surfaces of the rigid disk, the abrasive, tapes and cleaning tapes were passed over a Shore A 50 durometer elastomer roller which was not oscillated. The force between the roller and abrasive to the disk was about 8.8 kg. The endpoint of the test was 20 seconds. The surface of the textured disk was then measured using a WYKO interferometer using a 40× objective to determine the surface properties of the disk.

Surface Finish

The Ra of a surface is the measurement of the arithmetic average of the scratch depth. It is the average of 5 individual roughness depths of five successive measuring lengths, where an individual roughness depth is the vertical distance between the highest point and a center line. Rz is the average of 5 individual roughness depths of a measuring length, where an individual roughness depth is the vertical distance between the highest point and the lowest point. Rmax is the maximum roughness depth from the highest point and the lowest point in the measuring length.

The surface finish is usually measured with a profilometer which comprises a probe having a diamond tipped stylus. Examples of such profilometers include Surtronic, Surfcom, and Perthometer. Ra, Rz, and Rmax are usually recorded in micrometers or microinches. Extremely fine or smooth surface finishes, too smooth for a profilometer to measure, can be measured with a passive measurement device, such as a WYKO interferometer, and are usually recorded in nanometers or angstroms.

Example 1 was produced according to the Procedure for Making a Structured Abrasive Article Having Abrasive Composites. Two abrasive slurries were mixed. The abrasive slurry for Side A consisted of 1560 parts of a 70/30/1 TMPTA/TATHEIC/PH2 resin mix, 60 parts SCA, 60 parts ASF, 1200 parts KBF4, and 4120 parts WAO. For the WAO, 2472 parts was grade P-320 (having an average particle size of 45 micrometers) and 1648 parts had an average particle size of 40 micrometers. The second slurry, for Side B, consisted of 1600 parts of the resin mix, 60 parts SCA, 60 parts ASF, 1200 parts KBF4, and 4120 parts WAO, in grade P-180 (having an average particle size of about 75 micrometers). The viscosity of the two abrasive slurries was between 5000 and 6000 cps. The two abrasive slurries were coated side by side by placing a dividing dam having two compartments behind a knife coater, and pouring the slurries into the compartments. The two compartments of the dam were each approximately 7.5 cm wide, and the baffle separating the compartments was approximately 0.625 cm thick. The abrasive slurries were physically separated by the baffle of the dam. As the slurries passed under the knife coater, the slurries came into contact with each other and formed a distinct interface or merge line.

Comparative A was a conventional aluminum oxide single grade abrasive belt, grade P-320, commercially available from Minnesota Mining and Manufacturing Company, St. Paul, Minn., (hereinafter referred to as "3M") under the trade designation "201E".

Example 1 and Comparative Example A were test according to Test Procedure I. It was found that the convenience of the two grades side-by-side were advantageous for the golf club head workpieces. The surface finish from Example 1 (using both Sides A and B sequentially) was approximately 0.125 to 0.25 micrometers lower than that of Comparative Example A.

Example 2 was produced in the same manner as Example 1, except that the slurry for Side A comprised 4120 parts WAO, in grade P-120 (having an average particle size of about 127 micrometers), and was dyed to a bluish-purple shade, and the slurry for Side B comprised the same amount of grade P-240 WAO (having an average particle size of about 58 micrometers), and was gray in color. Both Sides A and B had the same topography, 355 micrometer high four sided pyramids.

Example 3 was produced in the same manner as Example 1, except that Side A of Example 3 used 40 micrometer WAO, and Side B used grade P-320 FAO (having an average particle size of about 47 micrometers). Both Sides A and B had a topography similar to that of Example 1, except that the four-sided pyramids were approximately 176 micrometers high. Example 3 was tested according to Test Procedure II and the results are shown in Table 1. All Ra results are reported in Table 1 in micrometers (microinches).

TABLE 1

| | Example 3 | |
|---|---|---|
| | Side A | Side B |
| avg. Ra | 0.40 (16) | 0.90 (36) |
| Rmax | 2.875 (115) | 6.0 (240) |

Example 4 was made in the same manner and with the same topography as Example 3, except that Side A had no abrasive particles. Side B was the same as Side B for Example 3. Example 4 was tested according to Test Procedure II and the results are shown in Table 2. All Ra results are listed in micrometers (microinches).

TABLE 2

| | Example 4 | |
|---|---|---|
| | Side A | Side B |
| avg. Ra | same as input | 0.675 (27) |
| max. Ra | 0.127 (5) | 5.425 (217) |

Example 5 was made in the same manner as Example 3, except that is Side B had composites having 176 micrometers high three sided pyramids having a base 352 micrometers wide, and each abrasive composite shape was generally identical to any adjacent composite. Side A was generally the same as Side A for Example 3 where the 176 micrometer high pyramids were such that no two adjacent composites had the same shape. Both Sides A and B of Example 5 used 40 micrometer WAO. Example 5 was tested according to Test Procedure II and the results are shown in Table 3. All Ra results are listed in micrometers (microinches).

TABLE 3

| | Example 5 | |
|---|---|---|
| | Side A | Side B |
| avg. Ra | 0.525 (21) | 0.725 (29) |
| Rmax | 3.925 (157) | 5.175 (207) |

Example 6 was produced in the same manner as Example 3, except that for Example 6 Side A had 355 micrometer high four sided pyramidal composites. Side B was the same as Side B for Example 3. Example 6 was tested according to Test Procedure If and the results are shown in Table 4. All Ra results are listed in micrometers (microinches).

TABLE 4

| | Example 6 | |
|---|---|---|
| | Side A | Side B |
| avg. Ra | 0.85 (34) | 0.85 (34) |
| avg. Rz | 5.9 (236) | 5.95 (238) |
| Rmax | 6.7 (268) | 7.4 (297) |

Examples 7 through 9 were produced according to the Procedure for Making a Lapping Abrasive Article. Two abrasive slurries, A and B, were mixed by the following procedure. 120.7 parts 50/50 MEK/TOL; 47.5 parts PR3; 5.2 parts SCA2; 1.6 parts SSC; and 200.0 parts WAO were combined in an alumina ball mill (with glass milling media) and milled for 16 hours. To this was added 46.9 parts MEK/TOL; 117.6 parts PR3; 11.6 parts POL; 22.9 parts TDI; and 0.69 parts CAT. Abrasive slurry A had a WAO average abrasive particle size of 3 micrometers, and abrasive slurry B had a WAO average abrasive particle size of 2 micrometers. The abrasive slurries A and B were coated side by side on three different backings to provide Examples 7, 8, and 9. The width of coating A was 0.68 cm (0.25 inch) and the width of coating B was 2.8 cm (1.12 inches).

Example 7 was coated on a 51 micrometer thick polyester backing; Example 8 was coated on a 120 micrometer thick paper backing; Example 9 was coated on a 178 micrometer thick nonwoven backing.

Examples 7 through 9 were tested on rigid disks according to Test Procedure III and the results are shown in Table 5. All Ra results are listed in nanometers (nm).

TABLE 5

| Example | Side A | Side B |
|---|---|---|
| 7 | 3.07 | 2.08 |
| 8 | 2.41 | 1.96 |
| 9 | 3.96 | 3.23 |

In addition to the abbreviations reported above, the following further abbreviations were used for the following examples:

| | |
|---|---|
| PEG200 | polyethylene glycol, commercially available from Sartomer Corp. under the trade designation "PEG 200 DA"; |
| PEG600 | polyethylene glycol, commercially available from Union Carbide under the trade designation "CARBOWAX 600"; |
| PEG400 | polyethylene glycol, commercially available from Union Carbide under the trade designation "CARBOWAX 400"; |
| ASF2 | fumed silica filler, commercially available from DeGussa under the grade designation "R-972"; |
| AB | acrylate blend of TATHEIC/TMPTA, commercially available from Sartomer Corp. under the trade designation "368C"; |
| CRY | potassium cryolite; |
| CMS | calcium metasilicate coated with a silane coupling agent, commercially available from Nyco Co. under the trade designation "WOLLASTOKUP"; |
| MWF | calcium carbonate (fine powder), commercially available from ECC International under the trade designation "MICROWHITE FILLER"; |
| ASC | amorphous silica clay commercially available from R.T. Vanderbilt under the trade designation "Peerless Clay #4"; |
| SF | silica flour, commercially available from U.S. Silica Co. under the trade designation "Sil-co-sil"; |
| KB1 | bensil dimethyl ketal, commercially available from Sartomer Corp. under the trade designation "KB1". |

Examples 10–13 were produced according to the Procedure for Making a Structured Abrasive Article Having Abrasive Composites, except that Examples 10–13 did not include abrasive particles, and each Example had a coating of a single abrasive nature.

Example 10 had composites which were circular posts, 114 micrometers in diameter, 127 micrometers high, at a density of 872 posts per square cm. The slurry, comprising binder precursor, consisted of 65.2 parts PEG200, 4.9 parts AEF, 2.0 parts PH2, and 27.9 parts PEG600. The slurry was coated on a 120 micrometer thick paper backing at 3 meters/min, and cured at 22.86 meters/min.

Example 10 was converted into 7.6 diameter "daisies", and tested on an eyeglass lens polishing machine, a "Coburn 5000" cylinder machine, available from Coburn Optical Industries, Inc., Muskogee, Okla. The lens workpiece was polycarbonate plastic, 76 mm in diameter, and pre-ground to a 212 spherical curve (2.12 Diopter).

The test lens workpieces were first "fined" with a conventional 15 micrometer silicon carbide lapping film for 2.5 minutes (commercially available from 3M under the trade designation "3M 416M Qwik Strip" fining pad) and then with a 4 micrometer aluminum oxide beaded lapping film for 2.5 minutes (commercially available from 3M Company under the trade designation "3M 356M Qwik Strip" fining pad). Each lens was then lapped for 2.5 minutes with the abrasive article of the Example. All lapping was done under a water flood.

A Perthen M4P profilometer (commercially available from Feinprüf GmbH, Germany) was used to measure the surface finish (Rtm). The Rtm was measured at the center of the lens and at four points approximately 0.65 cm from the edge of the lens.

After the second lapping step, the surface finish was 10.8 microinches (0.27 micrometers), and after lapping with Example 10, the surface finish was 9.5 microinches (0.24 micrometers).

Example 11 had 63 micrometer high, four-sided truncated pyramidal composites. The slurry, comprising binder precursor, consisted of 67.9 parts TMPTA, 29.1 parts TATHEIC, 1 part ASF, 1 part PH2, and 1 part SCA. The slurry was coated onto 76 micrometer thick polyester backing and cured at 15.24 meters/min.

Example 11 was converted and tested as described in Example 10. After the second lapping step, the surface finish was 10.8 microinches (0.27 micrometer), and after lapping with Example 11, the surface finish was 9.1 microinches (0.23 micrometer).

Examples 12 and 13 had 63 micrometer high, four sided truncated pyramidal composites. The slurry for Example 12 consisted of 96.0 parts AB, 1.0 part SCA, 1.0 part PH2, and 2.0 parts ASF2. The slurry for Example 13 consisted of 62.3 parts AB, 1.0 part SCA, 1.0 part PH2, 2.0 parts X, and 33.7 parts PEG400. Both Examples were coated on 76 micrometer thick polyester backing and cured at 15.24 meters/min.

Example 12 and 13 were converted into 10 cm "daisies" and tested on a Schiefer testing machine, commercially available from Frazier Precision Co., Gaithersburg, Md. The test workpiece was a cellulose acetate butyrate polymer disc. The abrasive article was secured to a foam back-up pad by means of a pressure-sensitive adhesive and the abrasive/back-up pad assembly was installed on the testing machine. The load was 4.5 kg. Testing was done under a water flood at a flow rate of 1 ml of water per second. Cut was recorded in grams. The speed of the abrasive daisy was 4.5 cycles/second and the endpoint of the test was 500 revolutions of the abrasive daisy.

Example 12 produced a cut of 0.0048±0.003 grams with a Rz of 14.8±5.6 microinches (0.38±0.14 micrometer). Example 13 produced a cut of 0.0018±0.001 grams with a Rz of 19.6±8.0 microinches (0.50±0.20 micrometer). A conventional 9 micrometer aluminum oxide lapping film (commercially available from 3M under the trade designation "Imperial Lapping Film") produced a cut of 0.044±0.026 grams with a Rz of 31.7±5.2 microinches (0.81±0.13 micrometer).

Examples 12 and 13 were again tested as described above, except that the test was run dry. Example 12 produced a cut of 0.027±0.01 grams with a Rz of 18.2±5.2 microinches (0.46±0.13 micrometer). Example 13 produced a cut of 0.007±0.005 grams with a Rz of 18.6±5.5 microinches (0.47±0.18 micrometer). A conventional 9 micrometer aluminum oxide lapping film (commercially available from 3M Company under the trade designation "Imperial Lapping Film") produced a cut of 0.044±0.026 grams with a Rz of 18.6±7.1 microinches (0.47±0.18 micrometer).

Examples 12 and 13 were again tested as described above, except that the test was run dry and on polycarbonate workpiece. Example 12 produced a cut of 0.020±0.058 grams with a Rz of 18.8±5.2 microinches (0.48±0.13 micrometer). Example 13 produced a cut of 0.003±0.004 grams with a Rz of 16.2±5.5 microinches (0.41±0.14 micrometer). A conventional 9 micrometer aluminum oxide lapping film (commercially available from 3M under the trade designation "Imperial Lapping Film") produced a cut of 0.051±0.0136 grams with a Rz of 28.7±5.6 microinches (0.73±0.14 micrometer).

Examples 12 and 13 were again test on polycarbonate workpieces under wet conditions, but no cut was achieved with either sample.

Examples 14–21 were produced according to the Procedure for Making a Structured Abrasive Article Having Abrasive Composites, except that Examples 14–21 did not include abrasive particles or filler particles, and each Example had a coating of a single abrasive nature.

The even numbered Examples, i.e., Examples 14, 16, 18, and 20, were made from a slurry consisting of 99 parts TMPTA and 1 part PH2. The odd numbered Examples, i.e., Examples 15, 17, 19, and 21, were made from a slurry consisting of 79.2 parts TMPTA, 19.8 parts TATHEIC, and 1 part PH2. Examples 14 and 15 had composites in the form of three sided pyramids, approximately 63 micrometers high with 120 to 150 micrometer bases; Examples 16 and 17 had composites in the form of approximately 175 micrometer high four sided pyramids, where no two adjacent pyramid composites had the same shape (such a pattern is taught by WO 95/07797); Examples 18 and 19 had composites in the form of approximately 350 micrometer high four sided pyramids, where no two adjacent composites had the same shape; and Examples 20 and 21 had high three sided pyramids, approximately 530 micrometers high with approximately 1050 to 1080 micrometer bases.

Examples 14 to 21 were converted into 10 cm circular disks and tested on a Schiefer testing machine, as described above, and under various conditions, as listed in Tables 6 to 9, below. Two samples were run for each Example except where noted. A conventional 0.5 micrometer aluminum oxide lapping film (commercially available from 3M under the trade designation "Imperial Lapping Film") was used as a Comparative.

TABLE 6

Cellulose Acetate Butyrate workpiece; Dry Conditions

| Example | Average Cut ($10^{-3}$ g) | Std. Dev. ($10^{-3}$ g) | Ra (microinch) | Std. Dev. (microinch) |
|---|---|---|---|---|
| 14 | 19.5 | 6.4 | 1.6 | 0.5 |
| 15 | 18.0 | 4.2 | 1.5 | 0.5 |
| 16 | 43.0 | 12.7 | 1.8 | 0.4 |
| 17 | 25.0 | 11.3 | 1.5 | 0.5 |
| 18 | 20 | 0.0 | 1.5 | 0.5 |
| 19* | 21 | 0.0 | 1.33 | 0.5 |
| 20 | 37 | 0.7 | 1.0 | 0.0 |
| 21 | 25.5 | 3.5 | 1.0 | 0.0 |
| Comp.** | 8.25 | 3.1 | 8.8 | 3.3 |

*Only one test was run for Example 19

**Four tests were run for the Comparative

TABLE 7

Acrylic workpiece; Dry Conditions

| Example | Average Cut ($10^{-3}$ g) | Std. Dev. ($10^{-3}$ g) | Ra (microinch) | Std. Dev. (microinch) |
|---|---|---|---|---|
| 14 | 12.5 | 3.5 | 1.3 | 0.5 |
| 15 | 8.0 | 0.0 | 1.3 | 0.5 |
| 16 | 26.5 | 10.6 | 1.7 | 0.5 |
| 17 | 15.0 | 7.1 | 1.7 | 0.5 |
| 18 | 37.0 | 19.8 | 1.7 | 0.5 |
| 19 | 6.0 | 4.2 | 1.7 | 0.5 |
| 20 | 23.5 | 0.7 | 1.8 | 0.4 |
| 21 | 12.5 | 1.4 | 1.0 | 0.0 |
| Comp. | NA | NA | NA | NA |

NA — not run

TABLE 8

Cellulose Acetate Butyrate workpiece; Wet Conditions

| Example | Average Cut ($10^{-3}$ g) | Std. Dev. ($10^{-3}$ g) | Ra (microinch) | Std. Dev. (microinch) |
|---|---|---|---|---|
| 14 | 9.0 | 31.4 | 1.6 | 1.3 |
| 15 | 6.0 | 4.2 | 2.0 | 2.2 |
| 16 | 23.0 | 9.9 | 1.0 | 0.0 |
| 17 | 6.5 | 3.5 | 1.0 | 0.0 |
| 18 | 17.0 | 4.2 | 1.0 | 0.0 |
| 19 | 12.5 | 4.9 | 1.0 | 0.0 |
| 20 | 40.0 | 1.4 | 1.0 | 0.0 |
| 21 | 13.0 | 1.4 | 1.0 | 0.0 |
| Comp.** | 7.0 | 4.8 | 5.5 | 1.7 |

**Four tests were run for the Comparative

TABLE 9

Acrylic workpiece; Wet Conditions

| Example | Average Cut ($10^{-3}$ g) | Std. Dev. ($10^{-3}$ g) | Ra (microinch) | Std. Dev. (microinch) |
|---|---|---|---|---|
| 14 | 2.0 | 0.0 | 2.0 | 2.2 |
| 15 | 0.0 | 0.0 | 1.6 | 1.3 |
| 16 | 0.0 | 0.0 | 1.0 | 0.0 |
| 17 | 1.0 | 0.0 | 1.0 | 0.0 |
| 18 | 13.5 | 4.9 | 1.0 | 0.0 |
| 19 | 0.5 | 0.7 | 1.0 | 0.0 |
| 20 | 2.5 | 2.1 | 1.0 | 0.0 |
| 21 | 5.0 | 4.2 | 1.0 | 0.0 |
| Comp. | NA | NA | NA | NA |

NA — not run

Examples 22 to 27 were produced according to the Procedure for Structured Abrasive Article Having Abrasive Composites, except that Examples 22–27 each had a coating of a single abrasive nature, and did de abrasive particles. Examples 22–27 included filler particles, as described above. All Examples 22–27 included composites that were approximately 350 micrometer high, four sided pyramids, where no two adjacent composites had the same shape. The composites were coated on a rayon cloth backing at a speed of 15.24 meters/min and cured with one 600 watt "D" bulb. The articles according to Examples 22–27 were converted into 7.6 cm×335 cm (3"×132") endless belts.

The slurry for Example 22 consisted of 66.77 parts KBF4 and 33.33 parts 70/30/0.75 TMPTA/TATHEIC/PH2 mixture. The slurry for Example 23 consisted of 62.36 parts CRY and 37.64 parts 70/30/0.75 TMPTA/TATHEIC/PH2 mixture. The slurry for Example 24 consisted of 55.56 parts CMS and 44.44 parts 70/30/0.75 TMPTA/TATHEIC/PH2 mixture. The slurry for Example 25 consisted of 54.15 parts MWF and 45.85 parts 70/30/0.75 TMPTA/TATHEIC/PH2 mixture. The slurry for Example 26 consisted of 39.33 parts ASC, 2.31 parts SCA, and 58.36 parts 70/30/0.75 TMPTA/TATHEIC/PH2 mixture. The slurry for Example 27 consisted of 30 parts SF, 30 parts KBF4, and 40 parts 60/40/0.75 TMPTA/TATHEIC/KB1 mixture.

Examples 22–27 were tested off-hand on a Bader backstand grinder having a belt speed of 1524 meters/min. Various workpiece materials were tested with the following results:

Example 22: no effect on stainless steel; produced wild scratches on brass; polished aluminum well but left random scratches; easily abraded pine wood.

Example 23: cut pine wood easily; polished stainless steel to an Ra of 6 microinches (0.15 micrometer); polished brass to an Ra of 6 microinches (0.15 micrometer); polished aluminum to an Ra of 7 microinches (0.175 micrometer).

Example 24: easily abraded pine wood easily; polished stainless steel; produced sparks when grinding titanium, but left too fine of a scratch pattern to measure; abraded brass lightly to an Ra of 8.5 microinches (0.21 micrometer); and abraded aluminum to an Ra of 10 microinches (0.25 micrometer).

Example 25: abraded pine wood at a cooler temperature than Examples 22–24 and 26–27; produced a scuff on brass and aluminum workpieces, but no significant material removal was observed.

Example 26: pine wood easily abraded; abraded brass to an Ra of 12 microinches (0.30 micrometer); produced a scuff on steel; produced sparks on titanium, but no significant material removal or surface finish refinement was observed.

Example 27: pine wood easily abraded; abraded aluminum with a fairly clean cut to an Ra of 27 microinches (0.68 micrometer); abraded brass to an Ra of 17 microinches (0.43 micrometer); abraded titanium to 11 microinches (0.27 micrometer); abraded stainless steel to 8.5 microinches (0.21 micrometer).

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A method of making a coated abrasive article comprising the steps of:

(a) simultaneously applying a first coating composition curable to provide a first abrasive coating having a first abrasive nature and a second coating composition curable to provide a second abrasive coating having a second abrasive nature different from said first abrasive nature on a front surface of a backing, said coatings being contiguous and nonsuperimposed; and (b) curing said first and second coating compositions to provide said coated abrasive article.

2. The method according to claim 1 wherein said backing has a front and back surface, and a machine direction, and step (a) is accomplished by introducing each of said coating compositions into a coater comprising a stationary applicator and a reservoir effective to temporarily store and physically separate each of said coating compositions and said coating compositions are separately applied to said front surface of said backing in said machine direction while moving said backing relative to said coater.

3. The method according to claim 2 wherein said coatings are applied by a knife coater and said reservoir comprises a dam having a compartment for containing each of said coating compositions.

4. The method according to claim 2 wherein said coatings are applied by a die coater.

5. The method according to claim 2 wherein each of said abrasive coatings comprises one or more components selected from the group consisting of abrasive particles, binder, filler, surfactant, and coupling agent, and at least one of said components in said first abrasive coating is different from the same component in said second abrasive coating.

6. A method of making an abrasive article comprising the steps of:

(a) applying a first composite coating composition curable to provide a first composite coating having a first abrasive nature and a second composite coating composition curable to provide a second composite coating having a second abrasive nature different from said first abrasive nature into a plurality of cavities in a production tool, wherein said first composite coating and said second composite coating are arranged in a side by side nonspaced manner;

(b) bringing a backing into contact with said composite coating compositions;

(c) curing said first and second composite coating compositions to first and second composite coatings, respectively, wherein each of said composite coatings comprises composites having the inverse shape of said cavities.

7. The method according to claim 6 wherein said composite coating compositions are applied by a knife coater.

8. The method according to claim 6 wherein said composite coating compositions are applied by a die coater.

9. The method according to claim 6 wherein each of said composite coatings comprises one or more components selected from the group consisting of abrasive particles, binder, filler, surfactant, and coupling agent, and at least one of said components in said first composite coating is different from the same component in said second composite coating.

10. The method according to claim 6 wherein said composites have a height between about 40 and 1040 micrometers.

11. The method according to claim 10 wherein said first abrasive nature and said second abrasive nature comprise different composite heights.

12. The method according to claim 6 wherein said composites have a shape selected from the group consisting of pyramidal, truncated pyramidal, conical, truncated conical, hemispherical, and prismatic.

13. The method according to claim 12 wherein said first abrasive nature and said second abrasive nature comprise different composite shapes.

* * * * *

UNITED STATES PATENT AND TRADEMARK OFFICE

CERTIFICATE OF CORRECTION

PATENT NO. : 6,080,215
DATED : June 27, 2000
INVENTOR(S) : Stubbs et al.

It is certified that error appears in the above-identified patent and that said Letters Patent is hereby corrected as shown below:

Column 1,
Line 29, after "have" delete "s".

Column 7,
Line 46, ""DUREL"" should read -- "DUREZ" --.

Column 17,
Line 4, "phenolici latex" should read -- phenolic/latex --.

Column 20,
Line 1, "If" should read -- II --.

Column 24,
Line 2, after "for" and before "structured" insert -- Making a --.
Line 4, "de" should read -- not include --.
Line 37, delete "easily", first instance.

Signed and Sealed this

Nineteenth Day of March, 2002

*Attest:*

*Attesting Officer*

JAMES E. ROGAN
*Director of the United States Patent and Trademark Office*